US005398610A

United States Patent [19]

Pavliny et al.

[11] Patent Number: 5,398,610

[45] Date of Patent: Mar. 21, 1995

[54] ANTI-WRAP DEVICE FOR A WEB PRESS

[75] Inventors: Mark Pavliny, Rolling Meadows; Edward Lewandowski, Hoffman Estates; William Lawrence, Addison; Michael Gregory, Wheaton; Guntis Ozers, Hinsdale, all of Ill.

[73] Assignee: Baldwin Web Controls, Lombard, Ill.

[21] Appl. No.: 36,928

[22] Filed: Mar. 25, 1993

[51] Int. Cl.[6] ..... B41F 5/04

[52] U.S. Cl. ..... 101/484; 101/219; 101/228; 226/11; 226/45

[58] Field of Search ..... 101/217, 219, 224–228, 101/232, 484, DIG. 41; 226/11, 42, 45, 124

[56] References Cited

U.S. PATENT DOCUMENTS

| | | | |
|---|---|---|---|
| 3,152,746 | 10/1964 | Kindseth et al. | 226/11 |
| 4,500,043 | 2/1985 | Brown | 226/45 X |
| 4,508,033 | 4/1985 | Fischer | 101/217 |
| 4,549,485 | 10/1985 | Nawrath | 101/219 |
| 4,748,910 | 6/1988 | Richter | 101/228 |
| 4,846,060 | 7/1989 | Proctor | 101/228 |
| 4,909,426 | 3/1990 | Crowley et al. | 226/45 X |
| 4,961,378 | 10/1990 | Balow et al. | 101/228 X |
| 5,163,371 | 11/1992 | Kotterer et al. | 101/484 |

FOREIGN PATENT DOCUMENTS

| | | | |
|---|---|---|---|
| 0292645 | 11/1988 | European Pat. Off. . | |
| 0476437 | 3/1992 | European Pat. Off. . | |
| 2519298 | 7/1983 | France | 101/228 |
| 2357208 | 5/1975 | Germany | 101/228 |
| 3822496 | 1/1990 | Germany . | |

OTHER PUBLICATIONS

*Web Catcher Manual,* Rev A, Item #A71669, Watch Tower Bible and Tract Society of Pennsylvania, Nov. 11, 1992.

*Primary Examiner*—Edgar S. Burr
*Assistant Examiner*—Christopher A. Bennett
*Attorney, Agent, or Firm*—Morgan & Finnegan

[57] ABSTRACT

A system and method for preventing a broken printing web from wrapping about or otherwise fouling the blanket cylinders of printing press units. The system and method includes a web tensioning device located downstream of the printing press units for maintaining tension upon a broken web and pulling the web from the printing press units. The device includes a plurality of web disturbance detectors for detecting a wave, ripple or other disturbance indicative of a web break. A pair of anti-wrap rollers located above and below the web are engaged upon detection of a web break to engage the web between them to exert tension onto the web and pull it from the printing units. The anti-wrap rollers are rotated at a surface speed nominally greater than the surface speed of the printing rolls. The anti-wrap rollers include a plurality of opposed peak and valley portions which enable them to interlock and grip the web along a line of contact.

22 Claims, 14 Drawing Sheets

ANTI-WRAP DEVICE FOR A WEB PRESS

FIELD OF THE INVENTION

This invention relates to a web control mechanism for preventing damage to a printing unit of a printing press in the event of a substantial loss of tension in a running web exiting from the printing unit such as would be caused by a break in the web. The invention is particularly useful in the commercial heat-set printing market where the printed product exits to dryer and chill units.

BACKGROUND OF THE INVENTION

In a typical printing unit the printed product is discharged from the printing unit and typically is directed downstream through a dryer unit, followed by a chill unit. Problems occur when a web break occurs downstream of the press such as in the dryer or chill unit.

Should there be a web break there is a possibility that the web will be directed back to the printing press where it will become entangled in the press rolls. More particularly, the end of the printing web may wrap around the blanket cylinder damaging the blanket and resulting in substantial down time and blanket expense. This problem is particularly acute when the operator is not even aware of the web break.

The prior art has suggested several solutions to the problem. One proposed solution is to provide sensor means for detecting web breaks within the dryer and/or chill units. The detectors may be of the air, infra-red, photoelectric, contact, ultrasonic or other type capable of detecting a web break and signalling such information to a circuit which would cause the press to stop its operation. However, the press may be running at speeds of 1,000 to 3,000 feet per minute. The press rolls do not stop immediately but periodically decelerate over a period of time perhaps ten seconds. During this period of time, substantial printed product can be emitted from the press causing damage to the blankets by wrapping in the printing units.

In order to alleviate the problem some prior art device utilize a web break detector which not only provides a signal which stops the press but also activates knife means or other severing device which severs the web. Preferably, the web severing device is located before the dryer so as to reduce the amount of untensioned web. But since there is a period of time before the press stops, there remains the possibility that the untensioned web will go back to the press units and be wrapped around the blanket cylinders.

In prior art web break detectors, the web break is detected mechanically, optically or electrically which activates a shearing mechanism downstream of the printing unit and shuts down the printing unit to prevent additional printed product from issuing from the printing press. During the time period between the web breaks and the press shut down, the paper printed product will continue to issue. However, since there is no tension in the printed product due to the web break, the paper web will become entangled with the blanket cylinder and impression cylinder and may wrap around the blanket in the blanket cylinder. Typically, the blanket on the blanket cylinder is fragile in nature and may easily be compressed or otherwise damaged. When this occurs the blanket may have to be replaced, which can be expensive. The blanket cylinder is also somewhat inaccessible. Accordingly, it is a time consuming, complicated task to remove the wound printed web from the blanket and associated cylinders and after this is done the blanket must be removed and then replaced by a new, fresh blanket. All of these steps are time consuming and will result in substantial press down time.

There have been numerous attempts to overcome the problems associated with the detection of a breakage of printed product during the printing process.

Another proposed solution eliminates the necessity for a web severing device. One such prior art attempt is shown and described in U.S. Pat. No. 4,846,060 to Proctor entitled "Printing Web Tensioning System." This prior art practice involves the use of at least a pair of rollers sometimes called anti-wrap rollers which are positioned downstream of the printing unit and immediately before the drying units. These rollers are normally positioned one on the upper and one on the lower side of the printing web. In normal operation, the rollers are spaced apart and not in contact with the web. Upon detection of a web disturbance indicating a likelihood of or actual web break, a mechanism is activated which causes the rollers on opposite sides of the web to come together with the printed product between the rolls along the width of the web. The rollers are rotated at a synchronized speed with respect to the speed of the printing cylinders. In this way, tension is supposed to be maintained on the web and the web will not be wrapped around and become entangled with the printing rollers. Although a certain amount of paper will be wasted as it is directed to the floor, such waste is minimal as compared to the problems, waste and expense associated with wrap around the blanket cylinders.

Another prior art proposal is shown and described in U.S. Pat. 4,549,485 entitled Paper Web Seizing Apparatus For Use With Printing Machinery. In this prior art device, rollers are provided so as to cause the broken web to wrap around rollers which are positioned downstream of the printing press.

Prior art devices made in accordance with U.S. Pat. No. 4,846,060 and modified versions thereof, have met with a certain amount of success in the commercial field when used at relatively low press speeds such as not in excess of 1200–1600 feet per minute.

One problem that has arisen with certain prior art devices is the perceived necessity for speed synchronism between the last printing rolls and the anti-wrap rolls so that the surface speed of these rolls is identical. It is very difficult to obtain the same surface speed for the last press rolls and the anti-wrap rolls for a variety of reasons such as problems associated with gearing, motors and the diameter of the respective rollers as well as diameter changes that occur from wrapping the web on the anti-wrap rollers.

If the surface speed of the anti-wrap rolls is slower than the surface speed of the press roll slack may occur in the area between the press rolls and the anti-wrap rolls. If a sufficient build up of slack occurs, the slack may work back to the press rolls and become wrapped around the blanket. Alternatively, if the surface speed of the anti-wrap rolls is too fast relative to the press rolls, excessive tension may result causing the web to break, causing the end of the web to wrap around the blanket. This may occur regardless of the press speed.

In addition, significant problems arise when the press speeds are increased above about 1600 feet per minute. In particular problems arise when the press speed is raised to about 3000 feet per minute. At these press speeds it has been found that it takes at least about seven seconds for a press to decelerate to a stop position after web detectors have signalled a press stoppage. During the time interval between the web break and the actual stopping of the press rolls it is possible that about 300 feet of paper will be fed through the last press feeding rollers. Without the anti-wrap rollers, the press rollers will become excessively wrapped and entangled with the printing product emitted from the press after the web breakage.

Additional problems may occur where the press is equipped with anti-wrap mechanisms such as in U.S. Pat. Nos. 4,846,060 and/or 4,549,485. The problem is that the diameter of these rolls will increase when the anti-wrap rolls thereafter are wrapped at a rate which will cause the roller speed to decrease and prevent all the excess printed web product from being taken up by such rollers. When this occurs the excess printed web product will be fed back to the printing press will cause the same problem of wrap around of the blanket cylinder as occurs without anti-wrap rollers.

Although the problems to which this invention is directed is not limited to breakage occurring in presses having dryer units, the breakage is more likely to occur in such an environment due to the severe temperature differentials.

Objects

With the foregoing in mind an object of this invention is to provide a mechanism for preventing damage to the press rolls of a printing press as a result of web breakage of the printed web product downstream of the press.

Another object of the invention is to provide a mechanism which minimizes down time and damage resulting from web breaks, after the printed web product moves downstream of the press.

Another object of this invention is to provide a mechanism for preventing excessive diameter build up on anti-wrap rollers so as to prevent wrapping of printed web product around the press rolls.

A still further object of this invention is to provide a mechanism for preventing severed printed product from returning to and being wrapped around the press rolls in the event of downstream web breakage by providing means for directing severed web product downwardly toward the floor.

A still further object of the invention is to provide a new and improved anti-wrap roll structure for preventing severed printed web from wrapping around the blanket cylinders by engaging the web at predetermined locations along the width of the running web.

A further object of this invention is to provide a mechanism for preventing blanket damage of the anti-wrap roll type that does not require synchronization between the surface speed of the press rolls and the anti-wrap rolls.

Another object of this invention is to provide a mechanism for preventing web wrap around the surface speed of the press cylinders when the presses are operating at high speed.

A further object of this invention is to provide a mechanism for preventing web wrap around the press cylinder when the press speed is in the range of 2000–3000 feet per minute, or higher.

Another object of this invention is to provide knife or stripper finger means in cooperative relationship with anti-wrap rollers and located downstream of the press rolls having means to engage the web at predetermined locations along the width of the web for preventing severed printed product from returning from the anti-wrap rollers to the printing press rolls in the event of web breakage downstream of the anti-wrap rollers.

Another object of this invention is to provide anti-wrap rolls in engagement with the web from the press located downstream of the printing press which rolls are uniquely constructed and arranged so that the surface speed thereof can be greater than the surface speed of the press rolls to permit the printed web to be dragged from the press without breaking the web.

A still further object of this invention is to provide anti-wrap rolls downstream of the printing press in conjunction with blade means for preventing the printed web product from being wrapped around the anti-wrap rolls.

Another object of this invention is to provide an anti-wrap mechanism wherein the rolls operate at a surface speed greater than the press rolls and which includes finger means positioned within grooves of the anti-wrap rolls for preventing printed web product from wrapping around the anti-wrap rolls.

Additional objects and advantages of the invention will be set forth in the description which follows and, in part, will be obvious from the description; the objects and advantages being realized and attained by means of the instrumentation, parts, apparatus, systems, steps and procedures particularly pointed out in the appended claims.

BRIEF DESCRIPTION OF THE INVENTION

Briefly described, the invention relates to a new and improved press system for use after printed product web breaks for preventing the printed web from returning to the press where it can become entangled in and wrap around the press rolls, particularly the blanket roll. More particularly, the invention relates to novel and improved anti-wrap rolls and accompanying apparatus which includes means for preventing a severed web from being wrapped around the anti-wrap rolls and for preventing the severed web from returning to the press rolls.

More particularly, the invention relates to an anti-wrap press tensioning system by which a wave or ripple or web break activates web disturbance sensors. The sensors are connected to means for moving the anti-wrap rolls relative to one another and cause the position of the anti-wrap rolls to move from an inoperative (or disengaged) position to an operative (or engaged) position where the rolls are adapted to engage the running web. The rolls include engaging means for engaging the web with longitudinal line contact at predetermined locations transversely across the width of the web. The engaging means includes a plurality of alternate circumferential flat clearance or groove portions and circumferential raised flat ring portions or web engaging. The rolls are arranged so that the groove portions of one roll are aligned with the raised ring portion of the adjacent roll. The invention includes means for preventing the printed web product from wrapping around the anti-wrap roll by providing knife stripper means for directing the web away from the nip between such rolls.

The invention further includes finger means in cooperative relationship with the grooves of at least one of the grooved rolls so as to prevent the web from wrapping around the rolls. The fingers are constructed so that the web is directed in an outward direction away from the printing press units.

The invention consists of the novel parts, constructions, arrangements, combinations shown and described.

The accompanying drawings which are incorporated in and constitute a part of this specification illustrate an embodiment of the invention and together with the description serve to explain the principles of the invention.

BRIEF DESCRIPTION OF THE DRAWINGS

The invention will now be described in greater detail by way of reference to the following drawings, wherein.

DETAILED DESCRIPTION OF THE INVENTION

Figure 1:
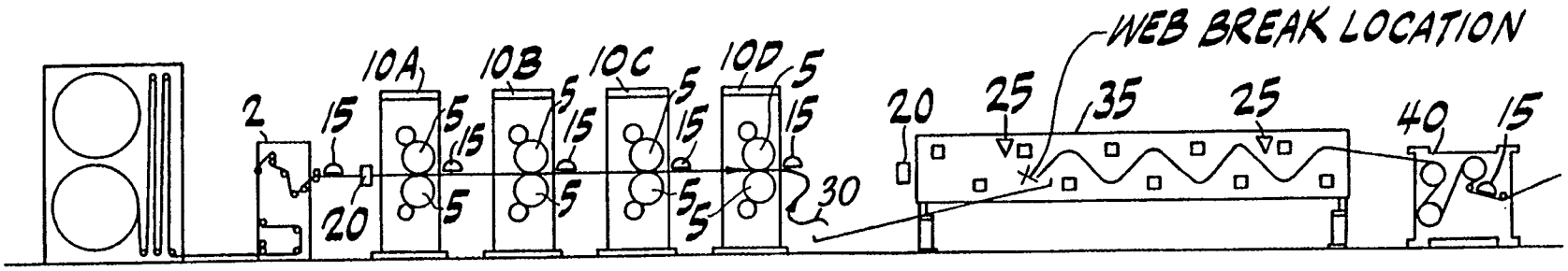
FIG. 1 PRIOR ART
FIG. 1 is a schematic overview illustrating a typical prior art web break detection system employed in conjunction with a typical multi-printing unit heat-set press.

Turning now to the drawings, wherein like numerals designate like components, FIG. 1 illustrates a prior application of a web-break detector, as employed in the art, for a multiple printing unit heat set press system. As shown, the press might include a plurality of printing units 10A–10D, each having one or more blanket impression cylinder combinations 5 employed in the printing process. When the printing units are running, the blanket cylinders 5 feed a continuous paper web 30 through the printing units, from an infeed unit 2 upstream from the printing units 10A–10D and then through a web dryer unit 35 and a chill unit 40 downstream of the printing units 10A–10D employed to complete the printing process.

Oftentimes, thermal stresses imposed on web 30 as the web is first heated in the dryer and/or then cooled in the chill unit, can cause the web to break downstream of printing units 10A–10D. In order to control the printing process, a plurality of web-break detectors 15 can be provided at various points in the system to detect when the web 30 breaks. Similar web break detectors 25 may be provided within the dryer units. The web-break detectors, which typically operate on infra-red, photoelectric, contact, ultrasonic, or other known principles, will, upon web breakage, detect the absence of the web 30 to relay a signal to the affected press units 10A–10D to stop their operation. As previously described, printing press units as encountered in use will oftentimes be operating at a speed in the range of 1,000 to 3,000 feet per minute, so that the stopping time of any press unit may take up to six to ten seconds, or longer.

Thus, in the event of a web break, there is the danger that, as printing units 10A–10D slow to a stop, the length of broken web 30 emanating from infeed 2 and through the printing units 10A–10D will reverse direction to feed back through the printing units and wrap around one or more of the blanket cylinders 5, thereby potentially causing the breakage of or disastrous effects to the blanket cylinders 5 located within the affected printing units.

In an attempt to prevent such deleterious effects, FIG. 1 illustrates that a prior practice entailed providing a plurality of web severing units 20, oftentimes located both prior to the first printing unit 10A and then after the last printing unit 10D adjacent the dryer unit 35. The web severing units would sever web 30 upon detection of a break to minimize the length of web 30 back-tracking upstream to the printing units 10A–10D as the presses were slowing to a stop. However, because the press units 10A–10D cannot come to an immediate stop, the blanket cylinders 5 continue to turn on deceleration, insuring that a quantity of broken web 30 would still wrap on to the blanket cylinders 5 and, in all probability, cause damage to the soft surfaced blanket cylinders.

Figure 2:
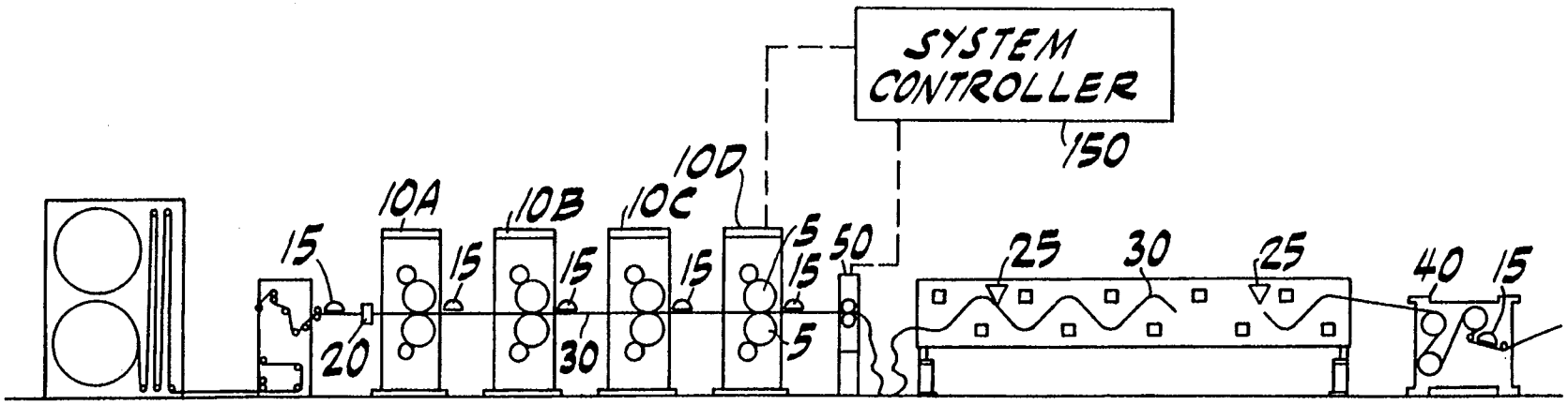
FIG. 2 is a schematic overview illustrating the web anti-wrap device of the present invention employed in conjunction with a typical multi-printing unit heat-set press.

To overcome these and other problems encountered with the prior practice, FIG. 2 illustrates a similar press system configuration as shown in FIG. 1, but employing the web anti-wrap device 50 according to the present invention. Because web breaks, as previously explained, will typically occur downstream from the press units, the anti-wrap device 50 is typically placed between the last printing unit 10D and the dryer 35.

As can be seen in FIG. 2, dryer web detectors 25 have detected a web break within the dryer unit 35. However, unlike in prior systems which require a speed match with the press rollers, the anti-wrap device 50 is engaged so that the rolls direct and pull web 30 out of the printing press units 10A–10D, without requiring a speed match with the press rolls, while those press units are decelerating to a complete stop. The web 30 will be directed away from the printing press units and harmlessly gathered on the shop floor space located between the device 50 and the dryer. Thus, the possibility of any wrapping of the broken web 30 back upstream from the dryer unit 35 and around the blanket cylinders 5 of the last printing unit 10D, or on any other of the printing units, is eliminated.

FIGS. 3A through 8 illustrate a preferred embodiment 50 of an anti-wrap device according to the present invention.

Turning to FIGS. 4A–6, the anti-wrap device 50 includes a frame 51 formed from two pairs of opposed vertical beams 55A, 55B. The frame 51 is braced across the front (web inlet) side and back (web outlet) side of the device by a pair of horizontal beams 75 bolted or otherwise affixed at their ends between the pairs of opposed vertical beams 55A, 55B. Frame 51 also includes two pairs of opposed side beams 85A, 85B that are affixed on both sides of device 50 between each opposed pair of vertical beams 55A, 55B.

As best seen in FIGS. 4A–6, the device 50 includes a pair of upper carriages 70A, 71A and lower carriages 70B, 71B located between each pair of opposed vertical beams 55A, 55B. The carriages are employed to carry the horizontally disposed anti-wrap rollers 60A, 60B, as will be more fully described. The outside edges of carriages which engage the sides of vertical beams 55A, 55B may be contained and shaped by means of bearings or other means (not shown) known in the art to enable the carriages 70A, 71A, 70B, 71B to be slidingly movable in a vertical direction between and along the lengths of vertical beams 55A, 55B.

Figure 4A:
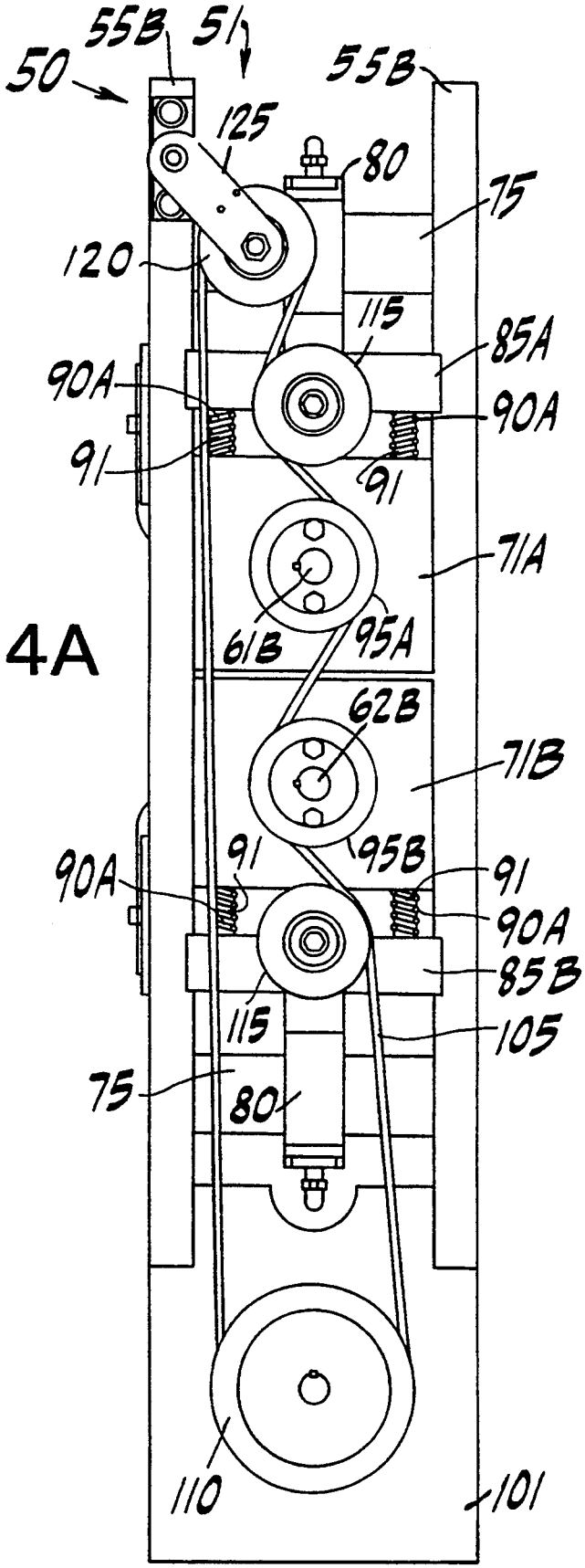
FIG. 4A is a side view of the embodiment shown in FIGS. 3A–3D illustrating the drive arrangement for the anti-wrap rollers.
Figure 4B:
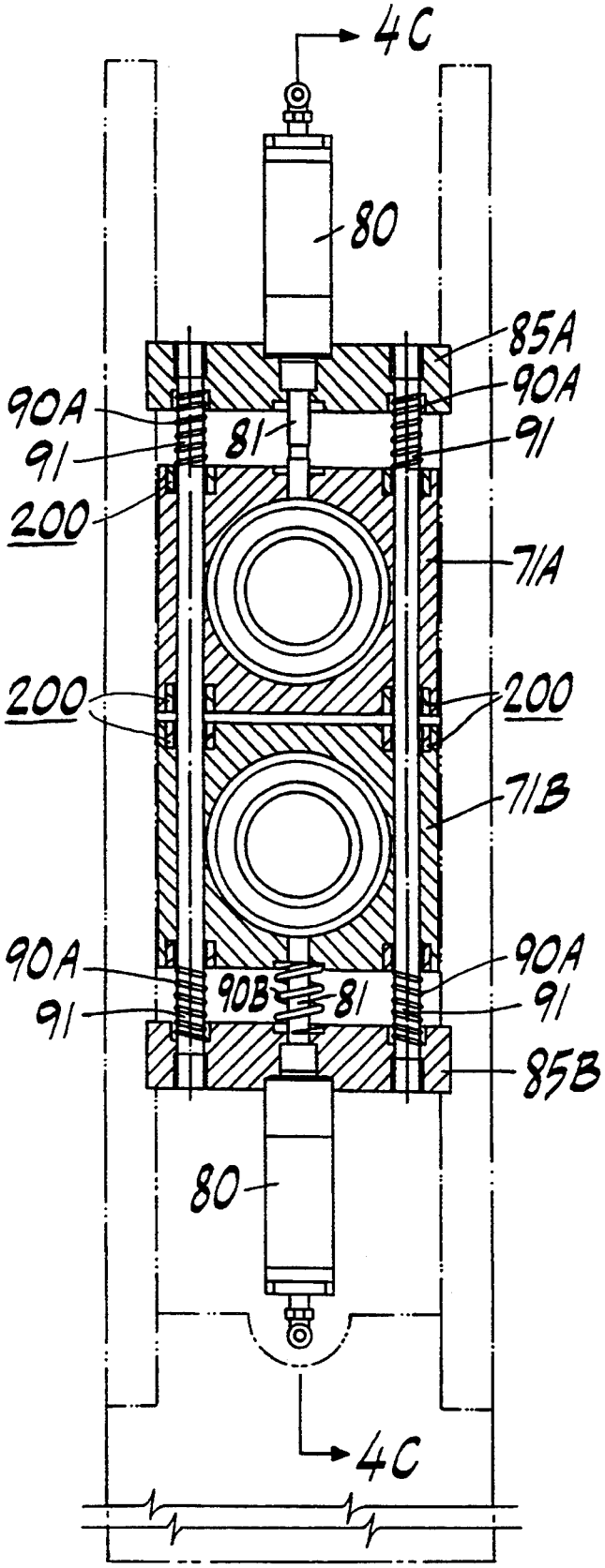
FIG. 4B is a partial cutaway side view of the embodiment shown in FIG. 4A further illustrating the configuration of the upper and lower carriages, the vertical rods, and the springs.
Figure 4C:
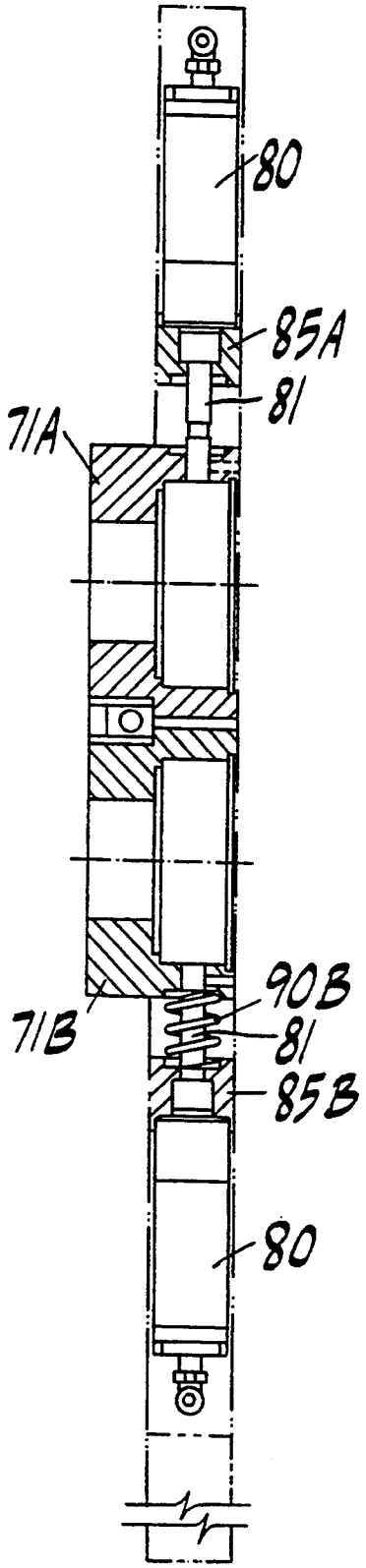
FIG. 4C is a cutaway side view taken along line 4C–4C of FIG. 4B.
Figure 5:
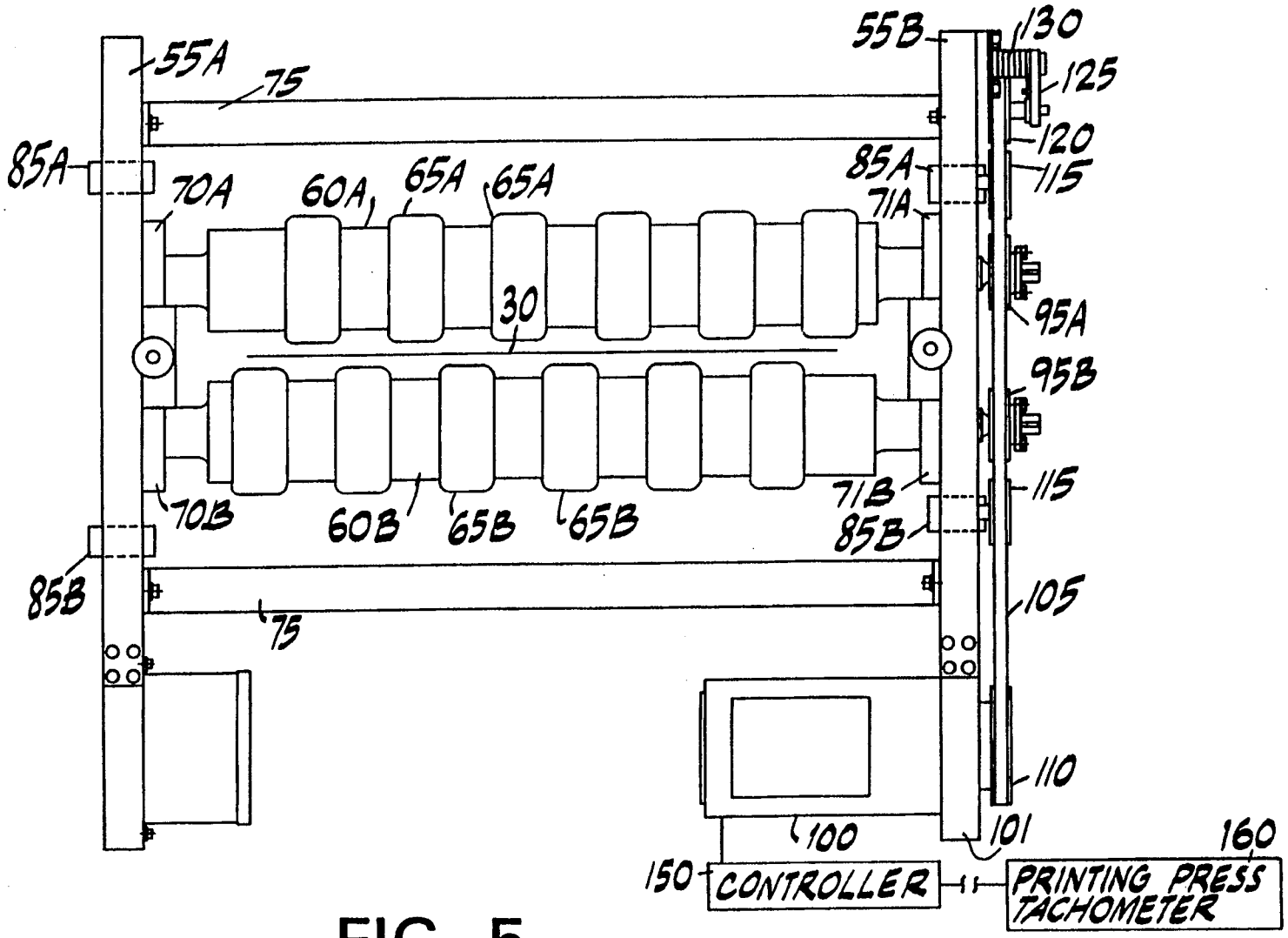
FIG. 5 is a rear view of the embodiment as illustrated in FIGS. 3A–4C illustrating the web anti-wrap rollers in a disengaged position from the web.

As shown in FIGS. 4A–4C, means are provided to displace the carriages 70A, 71A, 70B, 71B along the vertical beams. The means may include, for example, a plurality of pneumatic cylinders 80. The device features four such cylinders, one affixed to each end of both of the horizontal beams 75. Referring to FIGS. 4B and 4C, the cylinders each include a piston 81 that is free to run through and guided by a respective bore drilled or otherwise formed through side beams 85A, 85B. The free ends of the pistons 81 will then engage a respective upper carriage 70A, 71A or lower carriage 71A, 71B to be affixed or otherwise attached thereto. As will be later described, the displacement of the pistons 81 may be adjusted according to user need or desire to vary the displacement between anti-wrap rollers 60A, 60B in both their web engaged position (FIGS. 6 and 8) or when disengaged from web 30 (FIGS. 5 and 7). Factors dictating the spacing between the rollers include individual requirements of the press, such the thickness of the web 30 and the desired tension to be imparted thereto. In addition, to provide as rapid response as possible once a web break is detected, the pistons 81 may be set to provide a minimal necessary clearance (typically in the range of 1–2") to allow web 30 to pass between rollers 60A, 60B when the press units 10A–D are engaged and running.

The reaction time of the device in engaging web 30 following a web break is important. The more rapid the reaction time, the less likely it will be that web 30 can backlash upstream to damage blanket cylinders 5. In accordance with the invention, jump start reaction time means are provided to reduce the time between web break and web engagement with the anti-wrap rollers. As embodied, a "jump start" spring construction can be provided to assist the pneumatic cylinders 80 to move the carriages 70A, 71A, 70B, 71B and thus rolls 60A, 60B into their web engaging position in as rapid a manner as possible.

As seen in FIGS. 4A–4C, a pair of vertical rods 91 are vertically affixed, at their respective ends, to each of the side beams 85A, 85B. Referring to FIG. 4B, the rods 91 are passed through and are carried by respective bearings 200 journaled at each corner of the upper carriages 70A, 71A and the lower carriages, 70B, 71B, the rods thereafter passing completely through and freely, slidingly oriented and guided through bores or holes drilled or otherwise formed through respective upper carriages 70A, 71A and lower carriages 70B, 71B. As shown in FIGS. 4A–4C, springs 90A are threaded about each of the vertical rods 91 and wedged between the side beams 85A (or 85B) and a respective upper carriage 70A, 71A (or lower carriage 70B, 71B). To overcome any gravitational effects exerted upon the lower carriages 70B, 71B, a spring 90B may be threaded about each of the pistons 81 of the lower pair of cylinders 80 and oriented in a similar manner. The springs will assist the pneumatic cylinders 80 to move the carriages 70A, 71A, 70B, 71B along the rods 91 and adjacent the vertical beams 55A, 55B. Typically, springs 90A may have a spring constant in the range of 68.53 lb./in, with spring 90B being somewhat stiffer and having a spring constant of about 246 lb./in to overcome any dynamic resistance exerted against it by piston 81 as the piston is urged towards the web engaging position.

The springs 90A and 90B thus constantly urge the upper and lower carriages toward an operative position and will cause movement thereof before the activating cylinders 80 are charged by activation of the web break detector means.

As previously mentioned, and as best seen on FIGS. 5–8, the device features web anti-wrap rollers 60A, 60B which are rotatably mounted between the upper carriages 70A, 71A and the lower carriages 70B, 71B, respectively. The anti-wrap rollers 60A, 60B may be machined or otherwise formed from any suitable material such as steel, aluminum, cooper or the like. In order to promote a positive, even pulling force on the web, the rollers 60A, 60B are preferably dimensioned to be about 14 inches longer than the width of the web 30 for which the device is designed.

Figure 6:
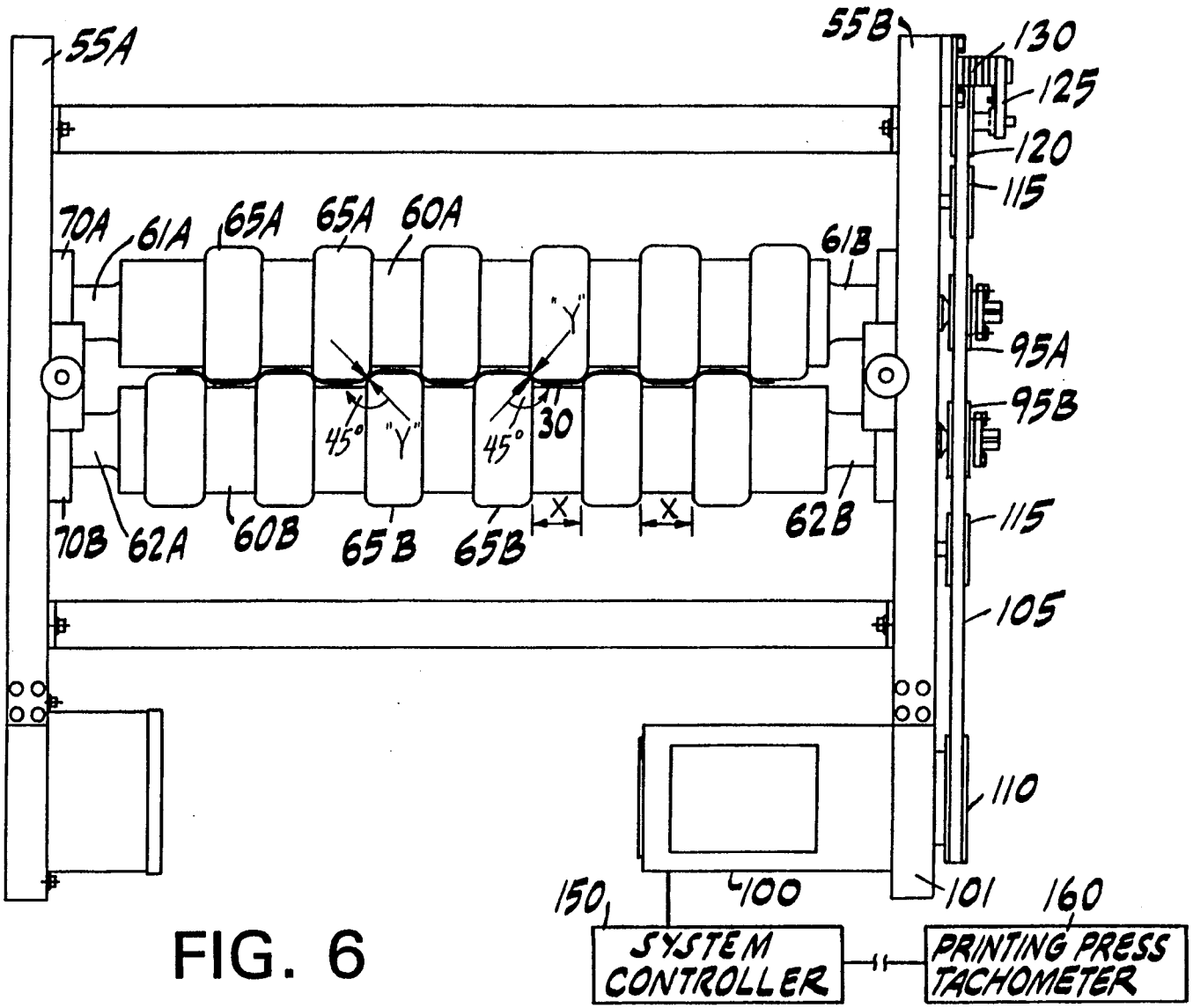
FIG. 6 is a second rear view of the embodiment illustrated in FIGS. 3A–4C illustrating the web anti-wrap rollers in their engaged position with respect to the web.
Figure 7:
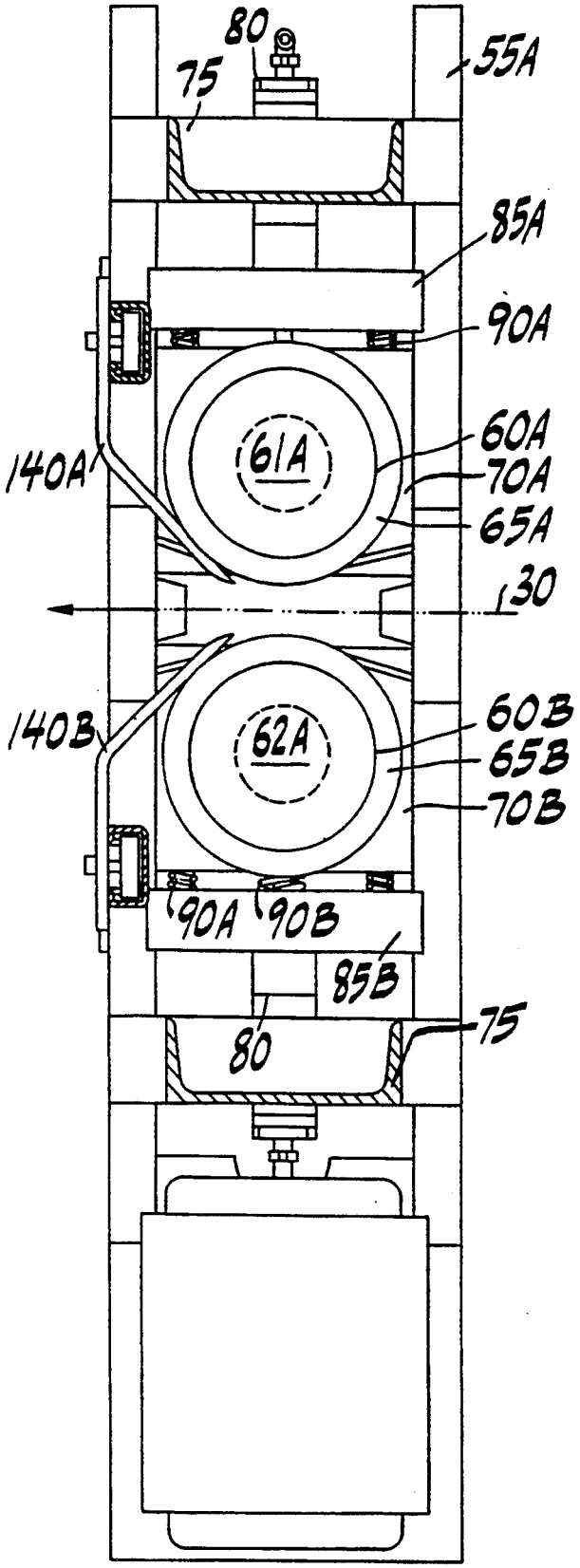
FIG. 7 is a cut-away side view of the embodiment illustrated in FIGS. 3A–6, showing the stripper fingers at the outlet side of the device and the relation of the stripper fingers to the web anti-wrap rollers when disengaged from the web.

As seen in FIGS. 5 and 6, the ends 61A, 61B of roller 60A is rotatably journaled via bearings or the like (not shown) to corresponding carriages 70A, 71A, with end 61B extending through the width of carriage 71A. The ends 62A, 62B of the anti-wrap roller 60B is similarly configured with regard to lower carriages 70B, 71B, with one end 62B extending through the width of carriage 71B.

As shown, the anti-wrap rollers include a plurality of web engaging rings 65A, 65B for exerting a gripping action onto the web as it is pulled through the device. As illustrated, the engaging rings are evenly displaced along the length of their corresponding rollers 60A, 60B. The rings 65A, 65B are preferable formed of rubber and may have a hardness rating of 50 durometer. The rings 65A, 65B may be fixedly attached to the anti-wrap rollers by suitable mechanical joining methods, such as tongue and groove fitting or force fitting, or they may be adhered to the anti-wrap rollers with conventional adhesives or bonding techniques. Preferably, adjacent rings 65A (or 65B) are spaced 1½"–2" apart from one another to define and provide adequate clearance portions or spaces between adjacent rings (see dimension "X" FIG. 6)

In accordance with the invention, means are provided for engaging the running printed web at predetermined selected locations along the width of the running web.

Preferably, the engaging means engages the web with line contact at selected predetermined locations in the longitudinal direction (along the length of the web) so as to exert sufficient force to pull web 30 through the rolls from the press units 10A–10D. With a line contact rather planar contact, slippage can occur, thereby preventing excessive tension which could cause web breakage. Due to the resilient covering on the rolls, the rolls can be adjusted so that the line (sometimes called "stripe") contact can range from thin to relatively thick.

As embodied and shown, rings 65A and 65B are arranged in a staggered configuration. That is to say, a given ring 65A will not be directly opposed by a ring 65B; rather, a given ring 65A will be oriented to interlock with and fit into the clearance space (dimension "X") formed between adjacent rings 65B when the anti-wrap rollers 60A, 60B are in an engaged configuration (see FIGS. 6 and 8). The staggered arrangement permits the anti-wrap rollers 60A, 60B to thus "capture" and engage the web in an interlocking manner with line rather than planar contact.

To this end, it is preferable that each interlocking pair of rings 65A/65B not make a direct surface contact with the web. Instead, as previously described, it is preferred that upon the activation of cylinders 80, the pistons 81 will extend to engage the rollers 60A, 60B to establish a clearance gap of approximately ⅛" to ⅜" between each interlocking pair of opposed rings 65A/65B as measured along a 45° diagonal (See dimension "Y" FIG. 6). The anti-wrap rollers 60A, 60B will thus engage web 30 in line contact at selected predetermined locations along the diagonals when in the engaged position (FIG. 6), so that web 30 will be "captured" between the anti-wrap rollers and drawn through the rollers 60A, 60B in a substantially rectangular sinusoidal cross-section. Because of the clearance gaps between the interlocked pairs of opposed rings 65A/65B, (see dimension "Y"), web 30 may freely pass between the anti-wrap rollers 60A, 60B. Owing to the interlocking action of the rollers upon the web, the rollers may exert sufficient pulling action on the web without imparting any undue tension upon the web or creating a nip point between rollers 60A, 60B. In the event the tension becomes excessive, slippage between the web and rolls will occur, thereby reducing the tension.

As seen in FIGS. 4A–6, the device includes means for rotating the anti-wrap rollers 60A, 60B. For example, a roller drive motor 100 may be attached to a plate 101 affixed to one said of frame 51. A pair of roller pulleys 95A, 95B are affixed to the respective protruding ends 61B, 62B of the anti-wrap rollers 60A, 60B. A pulley 110, mounted to the output shaft of motor 100, serves to transmit rotational force to the anti-wrap rollers via a drive belt 105. A pair of idler pulleys 115 are rotatably affixed to side beams 85A, 85B and engaged with the belt 105 to promote the even transmission of power from the motor 100.

In addition, a tensioning pulley 120 may be provided to automatically maintain proper tension on belt 105 as the rollers 60A, 60B travel up and down with their respective carriages 70A, 71A and 70B, 71B. As shown in FIGS. 4A and 5, the tensioning pulley 120 is rotatably affixed to an arm portion 125 which itself is rotatably mounted to a beam 55B. Arm portion 125 is biased against rotation by a spring 130. As the vertical positions of the rollers 60A, 60B are altered, the extended length of belt 105 will be varied so that the belt will exert a radial force either towards or away from the pulley 120; as such, arm portion 125 compensates for this length variation and, because of spring 130, will be biasingly and automatically rotated clockwise or counterclockwise, as appropriate, to maintain a proper tension on the belt 105.

As previously described, the speed of anti-wrap rollers 60A, 60B is configured to be somewhat above the running speed of the printing press units 10A–D. Typically, the surface speed of the anti-wrap rollers 60A, 60B can be configured to be in the range of 25 to 50%, or more, faster than the operating speed of printing units 10A–10D, to ensure that the anti-wrap rollers 60A, 60B will exert a positive and sufficient pulling action on the web emanating from the printing units in the event of web break. To this end, the speed output of motor 100 can be controlled by the system controller 150 and linked to a printing press tactometer 160 itself operatively linked, for example, to the last printing unit 10D. As the speed of the printing unit 10D is varied, appropriate signals are relayed by the tachometer 160 to controller 150 in order to adjust the speed output of motor 100 and, hence, the running speed of the anti-wrap rollers to ensure that the anti-wrap rollers constantly rotate at a greater speed than the printing units. Advantageously, the staggered, spaced configuration of the anti-wrap rollers 60A, 60B, together with the greater speed of the anti-wrap rollers above the running speed of printing press units 10A–10D, assure a sufficient action upon and positive drive of the web as the printing units are slowed, without any unnecessary tension or strain imparted upon the web by the rollers 60A, 60B.

Alternatively, one skilled in the art will realize that the system can be configured to permit the anti-wrap rollers 60A, 60B to rotate at a constant, fixed speed which is greater than the maximum operating speed of the printing press units 10A–10D for which the device is designed. Thus, the system in general and/or motor 100 may be configured to run the anti-wrap rollers at, for example, a fixed 25–50% speed differential greater than the maximum speed of the press units 10A–10D. In this manner, the system will ensure that the rollers 60A, 60B are always operating at a greater speed than the press units 10A–10D, thereby eliminating the need to monitor press speed with tachometer 160 and/or the attendant problems which might be encountered should tachometer 160, its connection to system controller 150, or the controller 150 itself, malfunction or fail.

In certain present printing operations press speeds have been increased to about 3000 feet per minute and possibly higher. An inherent problem occurs at such higher speeds in that, in the event of a web break, there is a higher likelihood that the blanket cylinder will be subjected to damage caused by wrapping of the broken web. The invention is particularly adopted for such higher press speeds by the provision of stripper finger means for preventing web wrap around the anti-wrap rolls. As embodied, this stripper or knife means includes a plurality of stripper knife-fingers 140A and 140B (see, i.e., FIGS. 3A and 3B).

Figure 8:
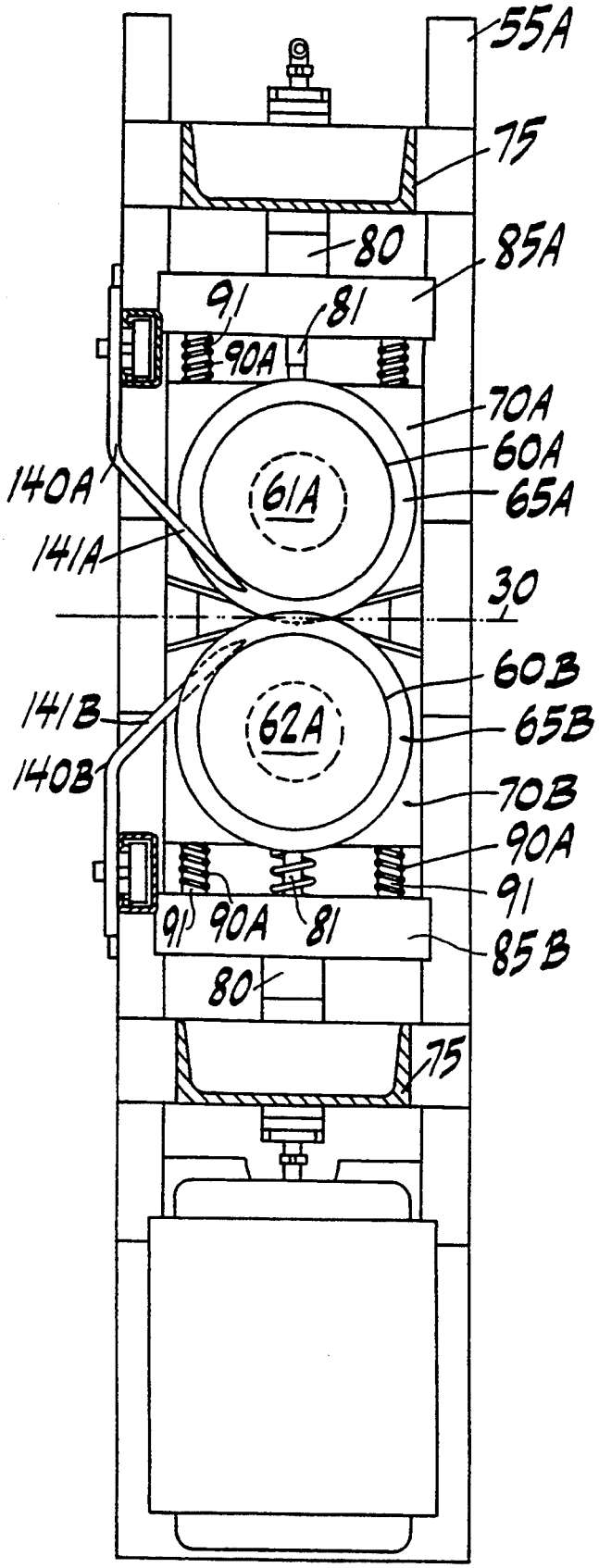
FIG. 8 is a second cut-away side view of the embodiment depicted in FIGS. 3A–6, illustrating the stripper fingers and their relation to the web anti-wrap rollers when the anti-wrap rollers are in an engaged position with regard to the web.

FIGS. 7 and 8 illustrate the anti-wrap rollers in disengaged and engaged positions, respectively, together with said plurality of stripper fingers 140A, 140B affixed to the outlet side of the device. The stripper fingers 140A, 140B are provided to prevent a broken web 30 from backtracking upstream through the device 30 from wrapping about and otherwise fouling anti-wrap rollers 60A, 60B. As shown, the stripper fingers 140A, 140B include inclined sections 141A, 141B that are nested between the spaced portions formed or otherwise defined between adjacent web-engaging rings 65A and 65B. When in the engaged position (FIG. 8), the inclined sections 141A, 141B are oriented to rest slightly above the surface of rollers 60A, 60B so as not to interfere with their rotation. The stripper fingers 140A, 140B prevent the web 30 from wrapping around the anti-wrap rollers and as press units 10A–10D slow to a halt, the stripper fingers 140A, 140B will direct the web to the shop floor (see FIG. 2) for safe gathering.

The device further provides means for detecting web breaks downstream of the press units. Said web detection means comprises means for detecting a ripple, wave or other disturbance in the web 30 that is often produced by or a presage to a break occurring downstream of the printing units. By detecting these telltale disturbances, the reaction time of the device is greatly enhanced.

Figure 3A:
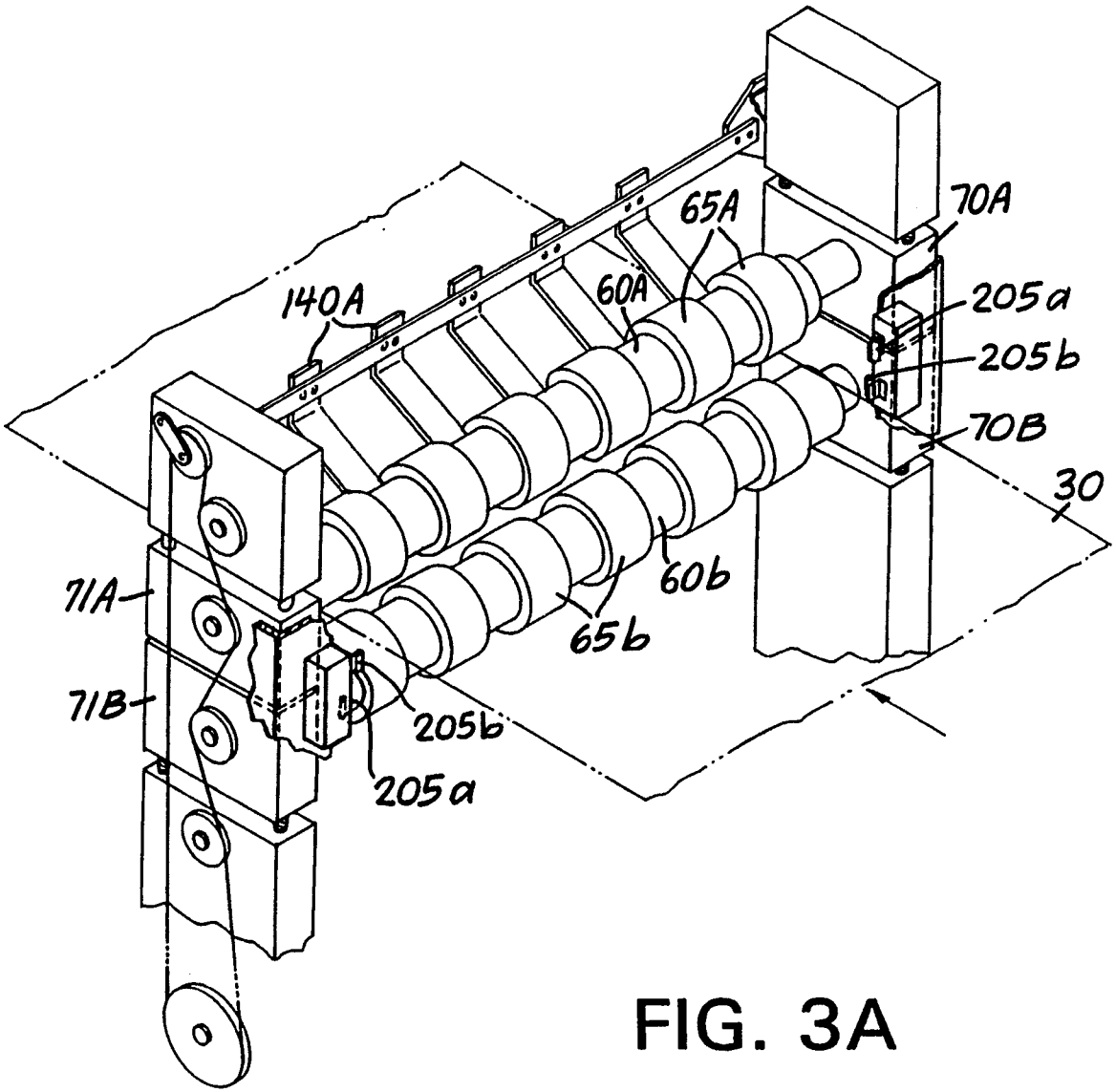
FIG. 3A is a frontal isometric view illustrating one embodiment of the web anti-wrap device illustrating the web disturbance detectors.
Figure 3B:
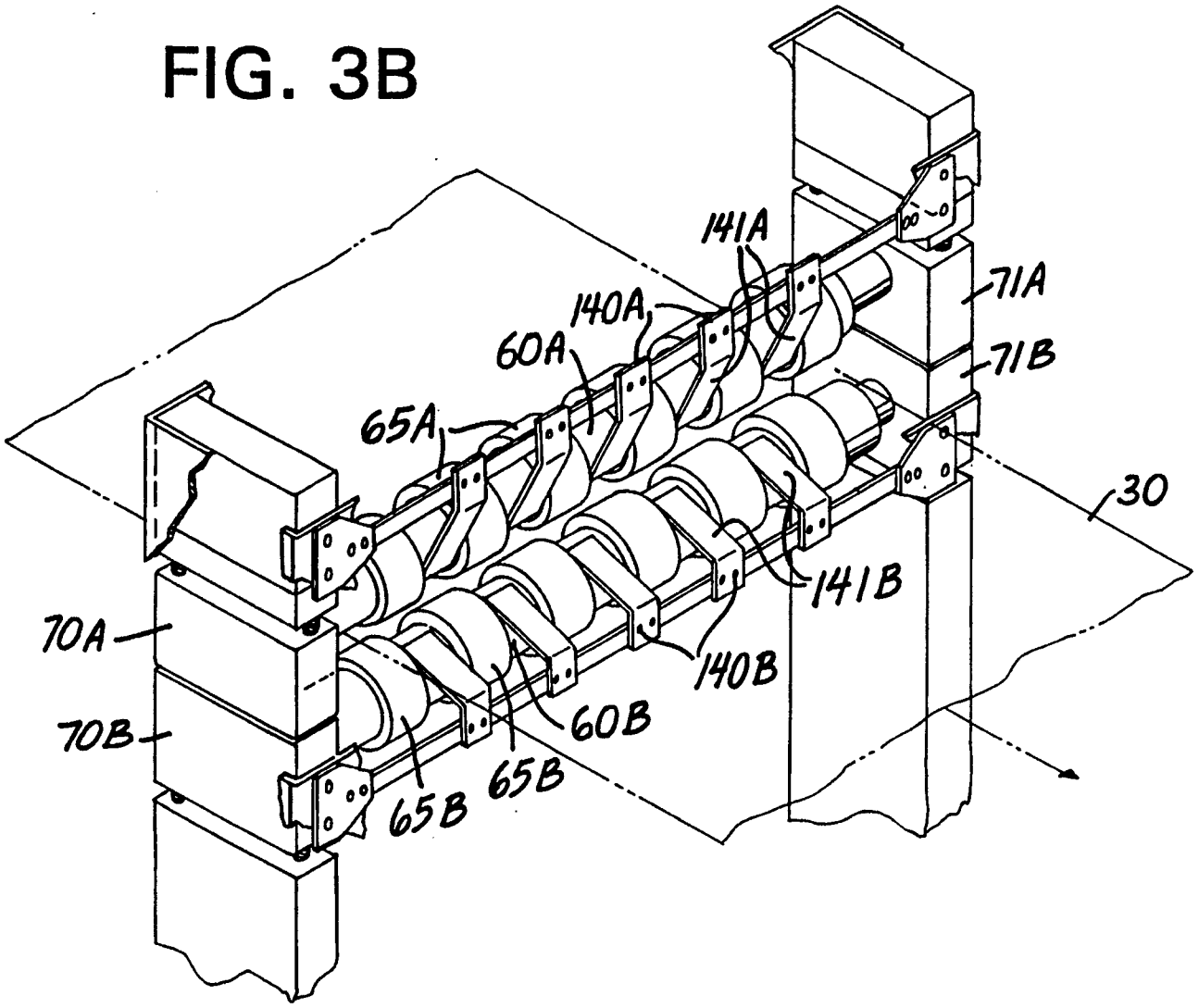
FIG. 3B is a rear isometric view of the embodiment illustration in FIG. 3A illustrating the relation of the web stripper fingers.
Figure 3C:
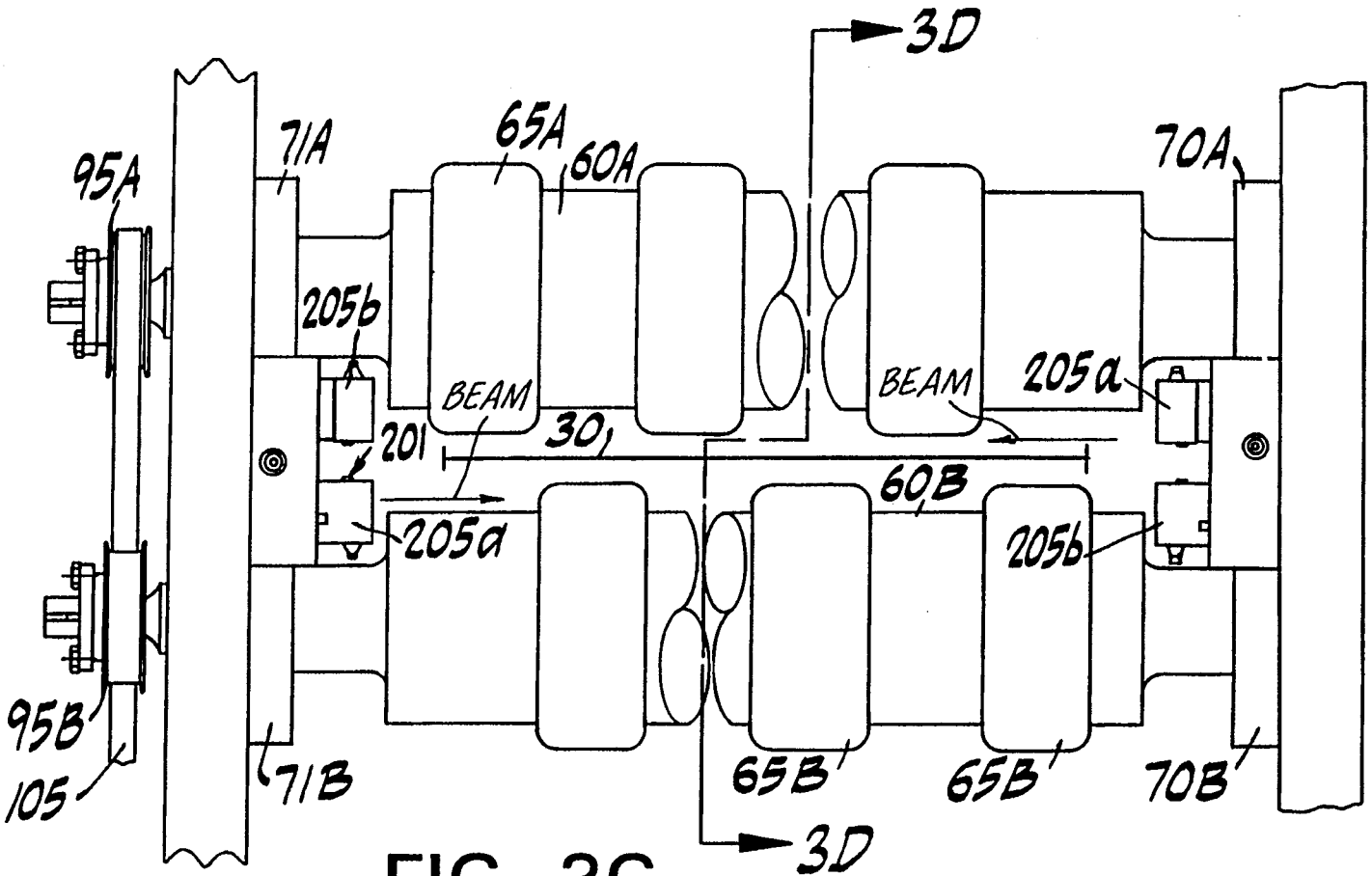
FIG. 3C is a frontal view of the embodiment illustrated in FIGS. 3A–3B showing the relation of the web disturbance detectors to the web and to the anti-wrap rollers.
Figure 3D:
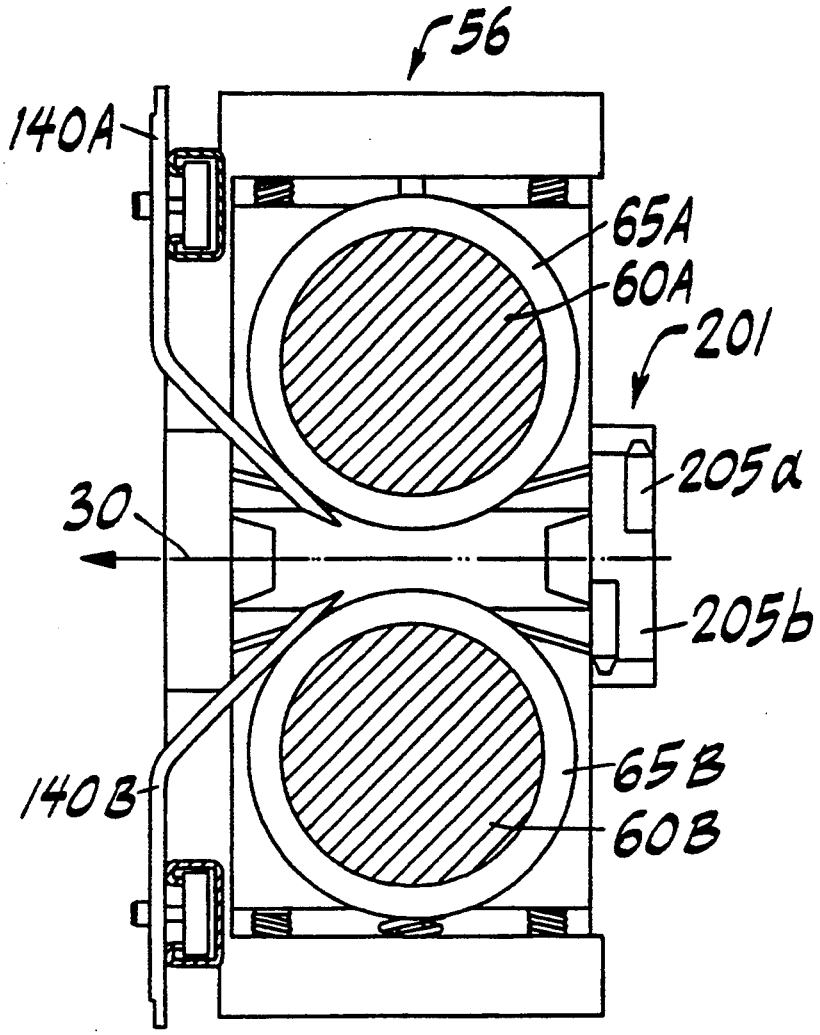
FIG. 3D is a cut-away side view of the embodiment illustrated in FIGS. 3A–3C as taken along line 3D–3D of FIG. 3C.

Referring to FIGS. 3C and 3D, the web disturbance detector means 201 comprises a pair of web disturbance transmitter/receiver pairs 205A/205B mounted at the front, inlet portion of the device 50. As embodied, the transmitter/receiver pairs may operate, for example, on infrared or visible light principles and may comprise, for example, an infrared type sensor, Model No. PZ-51L, as manufactured and sold by the Keyence Corporation of Osaka, Japan and Fair Lawn, N.J., U.S.A. As shown, one transmitter/receiver pair 205A/205B is placed above the web 30, while the second transmitter/-receiver pair 205A/205B is placed beneath the web 30. Both receiver/transmitter pairs are linked to the systems controller 150. As illustrated, each transmitter 205A will emit a beam to its respective receiver 205B in a direction perpendicular to the direction of and parallel to the plane of the web 30.

As previously explained, a web break will oftentimes be produce a ripple or wave transmitted along the length of the web 30. The ripple or wave will elevate vertically to break a horizontal plane defined by web travel. This vertical variation can be utilized to detect the onset of a web break and prompt quicker actuation of the anti-wrap rollers 60A, 60B.

Figure 9:
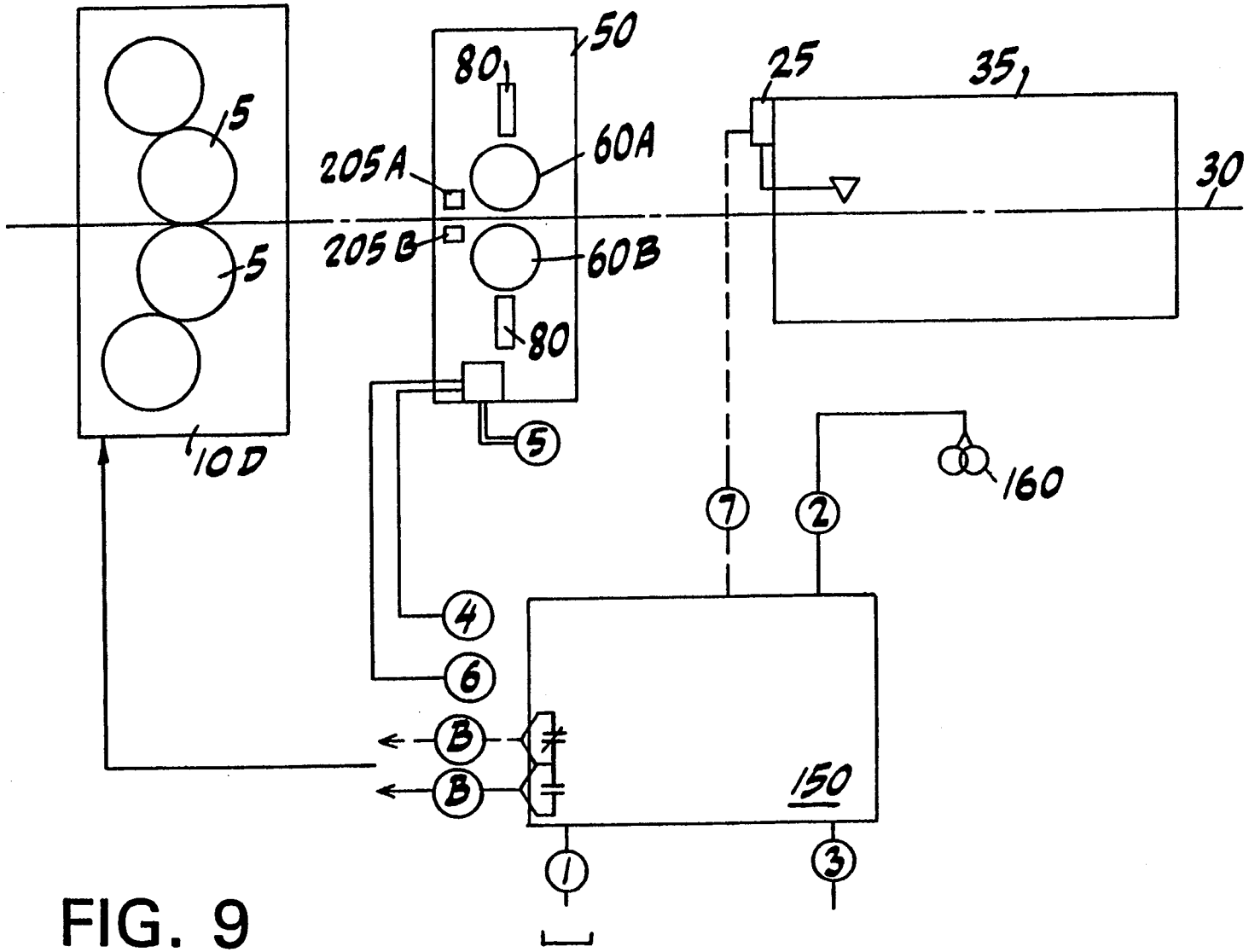
FIG. 9 is a schematic .illustration of the control arrangement for the device.

As illustrated, each web disturbance sensor pair 205A/205B may be placed, for example, a spaced distance of about $\frac{3}{8}''$ both above and below the surface of web 30. This allows for a typical or normal vertical variation or flutter which will be experienced by web 30 when operating normally and without break. However, upon or before a web break (FIG. 2), a ripple or wave caused by the break will cause the surface web 30 to break either of or both of the planes defined by the respective web disturbance detector pairs 205A/205B located either above or below the web. The infrared signal transmitted from transmitter 205A to receiver 205B will then be interrupted, causing a signal to be relayed from a receiver(s) 205B to the system controller 150 to commence actuation of the device 50. Simultaneously, a signal is relayed to the printing unit stop circuit (see FIG. 9) to shut down press units 10A–10D.

Operation

Operation of the device will now be explained by way of reference to the figures. When a break in the web 30 (see FIG. 2) has been detected by a disturbance detector pair 205A/205B, as previously explained the detector will signal the system controller 150 in order to activate a printing unit stop circuit (FIG. 9) to stop operation of the printing units 10A–10D. Simultaneously, the controller will activate operation of the anti-wrap device 50 to engage the web 30 and pull the web out of the last printing unit 10D, thereby preventing the broken web 30 from wrapping around blanket cylinders 5.

Upon activation, the system controller activates solenoids at a junction box adjacent the device (FIG. 9) to supply air to respective cylinders 80 to drive the pistons 81 from their disengaged position (FIGS. 5 and 7) towards their engaged position (FIGS. 6 and 8). As soon as the pistons are engaged, springs 90A and 90B assist the pistons, with the top springs 90A push downward on carriages 70A, 71A and bottom springs 90A and 90B push upward on carriages 70B, 71B. In this manner, the engagement motion of the carriages is accelerated so as to "jump start" the anti-wrap rollers 60A, 60B into rapid engagement with the web 30. The pistons 81 rapidly follow through on their full range of movement to lock the rollers 60A, 60B into their final engagement position (FIG. 8). Note that as the anti-wrap rollers 60A, 60B are already rotating above the speed of the press, pulling action is immediately imparted to the web as the printing units are slowing down. It is a further advantage that since the anti-wrap rollers are rotating faster than the blanket cylinders, as the web begins to go slack following the break and before the device is activated, the anti-wrap rollers can pull the slack. The web 30 is thereby effectively drawn from the last printing unit 10D and safely directed to the floor space prior to the dryer unit 35.

It will be apparent that other and further forms of the invention may be devised without departing from the spirit and scope of the appended claims, it being understood that this invention is not to be limited to the specific embodiments shown.

We claim:

1. A system for preventing damage to a printing press for use with a printing unit including printing cylinders, a moving paper web disposed between and in contact with said printing cylinders, monitoring means for monitoring the speed of said rotating printing cylinders and web break detector means for detecting a break in said paper web and staffing power to the printing cylinders, comprising:

(a) a pair of anti-wrap tension rolls attached to said printing unit downstream of the printing cylinders, said pair of anti-wrap tension rolls being disposed one above and one below the moving paper web and being capable of being movable from a first disengaged position wherein said tension rolls are spaced from the running web and a second engaged position wherein said tension rolls rollers are positioned in contact with said running web, (b) means responsive to said web detector detecting a web disturbance indicating said break for moving said upper and lower tension rolls relative to one another from said disengaged position toward one another to said engaged position; and (c) means spaced along the length of said upper and lower tension rolls for causing line contact with said web by said upper and lower tension rolls, said means for causing line contact being offset with respect to one another, said line contact being at predetermined spaced locations along the width of the web in a direction longitudinally of the web.

2. A device as defined in claim 1, wherein said means for causing line contact on said upper and lower tension rolls are evenly spaced along said tension rolls.

3. A device as defined in claim 2 wherein said means for causing line contact consists of a predetermined number of alternate flat peaks and flat valleys on each of said tension rolls and in a direction longitudinally with the web.

4. A device as defined in claim 3 wherein said flat peaks and flat valleys are offset so that a peak on one tension roller is adjacent a valley on the other tension roll.

5. A device as defined in claim 4 wherein the line contact with the web is caused by the corner of one flat peak on one tension roller engaging the web between the corner of the adjacent flat valley on the other tension roll.

6. A device as defined in claim 1 wherein means for moving said upper and lower tension rolls include piston and cylinder means and wherein said piston means is activated in response to said detection means.

7. A device as defined in claim 1 having spring means for causing relative movement of the upper and lower tension rolls.

8. A device as defined in claim 1 having stripper finger means for engaging the web to cause the web to be directed away from said tension rolls when said tension rolls are in an engaged position.

9. A device as defined in claim 8 wherein said stripper finger means are positioned within flat valleys of said upper and lower tension rolls when said upper and lower tension rolls are in the engaged position.

10. A system for preventing damage to the printing cylinders of a web printing press by maintaining tension in a web of said web printing press after it has been fed from the printing cylinders in the event of web breakage downstream of the press comprising:

(a) frame means positioned downstream of the printing cylinders through which the web is fed by the printing cylinders;

(b) upper and lower tension roll means mounted on said frame means positioned to receive the web between said upper and lower tension roll means;

(c) means for causing rotation of said upper and lower tension roll means at a surface speed greater than the surface speed of the printing cylinders;

(d) engaging means on said upper and lower tension roll means for selectively engaging the web so as to apply sufficient tension to the web to advance the web without breaking the web;

(e) said engaging means on said upper and lower tension roll means engaging the web with line contact at predetermined spaced locations across the width of the web; and (f) stripper finger means for preventing a broken web from wrapping around said upper and lower tension rolls.

11. A system as defined in claim 10 wherein each of said tension roll means are provided with offset flat peaks and flat valley portions and wherein the web is engaged between the mating edges of opposite flat valley and flat peak portions on said upper and lower tension rolls.

12. A system as defined in claim 10 further including tachometer means operatively linked to said printing cylinders for controlling the surface speed of said upper and lower tension roll means.

13. The system as defined in claim 12 wherein said upper and lower tension roll means are rotated at a surface speed nominally greater than the instant surface speed of said printing cylinders.

14. The system as defined in claim 10 wherein said upper and lower tension roll means are rotated at a fixed surface speed nominally greater than the maximum surface speed of said printing cylinders.

15. A system as claimed in claim 10 further including means for detecting a web break operatively engaged to said means for engaging said upper and lower tension rolls.

16. A system as claimed in claim 15 wherein said means for detecting a web break comprises means for detecting a web disturbance indicating said web break.

17. A system as defined in claim 16 wherein said means for detecting a web break comprises a pair of web disturbance transmitter/receivers disposed on either side of said web.

18. A method for preventing damage to the printing cylinders of a web printing press in the event of web breakage downstream of the press by maintaining tension in the web after it has been fed from the printing cylinders, comprising the sequential steps of:

(a) detecting a web disturbance indicative of a web break;

(b) rotating at least two anti-wrap tension rolls at a faster speed than said printing cylinders;

(c) engaging said anti-wrap tension rolls with said broken web downstream of said printing press, said anti-wrap rolls continuing to rotate at a faster surface speed than said printing cylinders; and (d) pulling said broken web away from said printing cylinders with line contact exerted by said anti-wrap tension rolls; and (e) allowing slipping to occur between said web and said anti-wrap tension rolls.

19. The method of claim 18, further including the step of simultaneously stopping said printing cylinders and activating said anti-wrap tension rolls upon detection of said web disturbance.

20. The method of claim 18, wherein said pulling step includes the step of preventing said broken web from wrapping on said anti-wrap tension rolls.

21. The method of claim 18 wherein said engaging step includes the step of engaging said broken web with anti-wrap tension rolls each having a plurality of alternate flat peaks and flat valleys.

22. The method of claim 18, wherein said engaging step includes the step of moving said anti-wrap tension rolls into engagement with said broken web.

* * * * *